United States Patent [19]

Wegryn et al.

[11] 4,311,399

[45] Jan. 19, 1982

[54] METHOD AND APPARATUS FOR SETTING AND VARYING MARGINS AND LINE SPACING ON DATA PRINTERS

[75] Inventors: William Wegryn, Ann Arbor; Juan F. Velazquez, Saline, both of Mich.

[73] Assignee: Sycor, Inc., Ann Arbor, Mich.

[21] Appl. No.: 60,335

[22] Filed: Jul. 25, 1979

Related U.S. Application Data

[63] Continuation of Ser. No. 766,242, Feb. 9, 1977, abandoned.

[51] Int. Cl.[3] ..... B41J 5/30

[52] U.S. Cl. ..... 400/76; 400/64; 400/124; 400/279; 400/317.1; 400/320; 400/322; 400/323; 400/328; 400/342; 400/568; 400/569; 400/583; 400/902; 400/903

[58] Field of Search ..... 400/64, 65, 76, 83, 400/124, 289, 317.1, 320, 320.1, 322, 323, 328, 335, 545, 555, 568, 569, 613.1, 902, 279, 903, 342, 583

[56] References Cited

U.S. PATENT DOCUMENTS

| | | | |
|---|---|---|---|
| 3,557,929 | 1/1971 | Schaaf | 400/902 |
| 3,764,994 | 10/1973 | Brooks et al. | 400/124 X |
| 3,779,359 | 12/1973 | Morrison | 400/317.1 |
| 3,850,279 | 11/1974 | Kolpek | 400/83 X |
| 3,858,703 | 1/1975 | Duley | 400/124 |
| 3,915,278 | 10/1975 | Spence et al. | 400/64 |
| 3,923,137 | 12/1975 | Kashio | 400/64 |
| 3,923,138 | 12/1975 | Willcox | 400/76 |
| 3,970,183 | 7/1976 | Robinson et al. | 400/65 X |
| 3,998,311 | 12/1976 | Greek, Jr. et al. | 400/613.1 X |
| 4,026,402 | 5/1977 | Byrd | 400/64 |
| 4,031,996 | 6/1977 | Busch | 400/279 |

OTHER PUBLICATIONS

IBM Technical Disclosure Bulletin, "Electromechanical Left-Hand Final Stop", Baker et al., vol. 18, No. 7, Dec. 1975, pp. 2218-2219.

*Primary Examiner*—Ernest T. Wright, Jr.

*Attorney, Agent, or Firm*—Price, Heneveld, Huizenga & Cooper

[57] ABSTRACT

The specification discloses a method and apparatus for setting and varying margins, line spacing and printing direction of a data printing machine by a machine user before and during printing by use of a keyboard with push-button control which is coupled to a digital controller to input information about the actual and the desired location of a print head relative to a printing surface, in response to which the controller outputs signals which control relative motion of the print head and indexes its relative position, from the actual to the desired direction and location.

24 Claims, 14 Drawing Figures

36

| | | |
|---|---|---|
| TOP OF FORM 36(k) | VERTICAL TAB 36(j) | LINE FEED 36(c) |
| LEFT 36(g) | RIGHT 36(e) | LEFT MARGIN 36(b) |
| UP 36(d) | DOWN 36(f) | SET FORM 36(a) |
| RUN 36(i) | STOP 36(h) | |

METHOD AND APPARATUS FOR SETTING AND VARYING MARGINS AND LINE SPACING ON DATA PRINTERS

CROSS REFERENCE TO RELATED APPLICATION

This is a continuation application of copending application Ser. No. 766,242, filed Feb. 9, 1977 and now abandoned.

BACKGROUND OF THE INVENTION (1) Field of the Invention

This invention relates generally to the control and operation of data printing machines; and, more particularly, to setting and varying the margins and line spacing of printed data and determining the direction of printing.

(2) Prior Art

The prior art teaches various mechanical means whose adjustment or manipulation before printing begins, or during interruption in printing, will institute changes in the margins and spacing between lines of printed data. For example, mechanical limits or stops can control the extremities of travel of a print head and can be adjusted to a desired position before printing begins. Similarly, varying the spacing between lines of printed data is usually accomplished by such means as manual adjustment of a mechanical gearing arrangement or slip clutch which vertically moves a printing surface in relation to a printing head. For example, the printing surface (i.e., paper entrained over a roller) can be moved by freeing the roller from its normal drive mechanism and freely rolling it a desired distance, thereby moving the paper with the roller.

Once mechanical margins have been established for a printing machine, it is known that either the left-hand or right-hand margin of a line of printed data can in effect be moved inwardly by the insertion of blank data either at the beginning or ending of the line. The blank data can be inserted by the operator of the printing machine before the affected line starts to print, or can be included in the data introduced into the printing machine. A frequently used method of introducing data into a printing machine is the use of punched cards. To move a left-hand margin of a line of printed data to the right, the punched card would include blank data representative of the desired amount of movement to the right of the left-hand margin. In either case, operator insertion or data insertion, the insertion of blank data would vary a given margin only for a single line of printed data, and subsequent variation of a margin would require subsequent additional introduction of blank data. Also, variation of the margins can only be inwardly relative to the particular margin (i.e., to the right of a left-hand margin, or to the left of a right-hand margin).

SUMMARY OF THE INVENTION

This invention provides a method and apparatus for setting, and for varying both the margins and the spacing between printed lines of data, both before and during printing by a printing machine, merely by operation of a push-button control. For example, the left-hand margin of a data line can be moved to the left or the right during printing and once set the margin will be maintained, without additional instructions, for all subsequent printed data lines until the margin is changed again by printing machine operator action. An embodiment of this invention can also include control of the direction of printing, i.e., printing a data line either from the left or the right, as a function of minimum printing time.

A data printing machine in accordance with the invention has a print head which can be driven laterally across a platen and which, by a coded address, can be uniquely located when positioned at a number of equally spaced, fixed positions along the platen. One of the fixed positions is used as a reference location by an encoder indicating the relative position of the print head. A paper drive is used to vertically position a printing surface in relation to the print head. The data printing machine further includes a memory, an electronic controller and a keyboard coupled together for enabling an operator to control printing, selection of left-hand margin location, variation to the left or right of the left-hand margin location, selection of data line spacing and variation of data line spacing. The memory is coupled to the encoder and paper drive and stores the lateral position of the print head, the reference location, the left-hand margin position, and the line spacing. The electronic controller controls the relative position of the print head and the printing surface and actuates printing. The keyboard provides an interface for transmission of data between the data printing machine and the printing machine operator.

Variation of margins and line spacing both before and during printing in accordance with an embodiment of this invention can be used to eliminate a variety of printing problems. For example, if a printing machine is being used to complete blank spaces in an otherwise preprinted form, a positional printing error in the preprinted portion of the form, e.g., a misalignment to the bottom and right of the printed matter with respect to the physical edges of the form, can be compensated for by an adjustment of the margins or line spacing of the printed data. Similarly, variations in the loading of the preprinted form into the printing machine can be compensated for by varying margins and line spacing. Also, if the input instructions governing the printing of data contain an error resulting in mispositioning of the printed data, the machine operator can make adjustments in margins and line spacing to compensate for the error without the need for correcting the input instructions. In all of the above cases, the corrections are quickly and easily accomplished by the operator, and need be done only once if the desired correction is repetitive.

The determination of whether printing forward or printing backward is the quickest way to print a given data line makes use of numerical addresses, referenced to a fixed horizontal reference location, representing the horizontal (or lateral) position of the ends of the next data line to be printed and the horizontal position of the print head. The advantages of basing a numerical address for determining horizontal position of the print head upon a fixed location instead of a variable location such as the preceding location to the left of the print head is that any error is not cumulative. More particularly, if each address is independently related to the address of a fixed point instead of successively related to the addresses of previous printing positions, an error in one address is not cumulative and does not lead to errors in all subsequent addresses.

DETAILED DESCRIPTION OF THE PREFERRED EMBODIMENT

Figure 1:
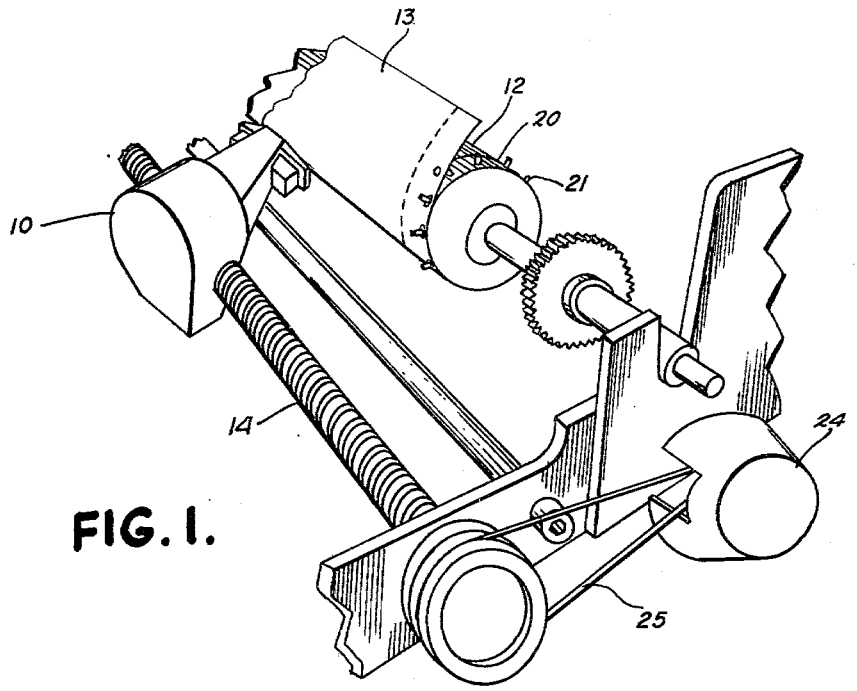
FIG. 1 is a fragmentary frontal perspective view of a printing machine print head, drive, and platen which can be used in accordance with an embodiment of this invention.

Referring to FIG. 1, the elements of a printing machine operated and controlled in accordance with an embodiment of this invention include, for illustration, a print head 10 laterally driven along a roller-type platen 12 by a worm-gear or lead screw-type drive 14. Worm-gear drive 14 is rotationally coupled (as by a drive belt 25) to an encoder 24, which produces electrical pulses in response to rotation of the worm-gear, or lead screw drive 14, which also produces lateral movement of print head 10. Thus, the train of pulses from the encoder 24 corresponds directly to print head travel and position. A pin-feed drive element 20 has paper-driving sprockets or pins 21 at both ends of platen 12, for vertically driving paper 13 or other printing surface (not shown) between print head 10 and platen 12. A digitally encoding keyboard 36 (FIG. 2) is electrically coupled to the printing machine, as discussed hereinafter, to provide an input from the operator of the printing machine for control of the machine. Print head 10 can be of the type, for example, having a single column of solenoid-driven impact needles or styli (not shown) for forming dots on a printing surface supported by platen 12. Print head 10 is positioned laterally along platen 12 so that adjacent dot positions can be used to form coherent groupings of dots representing characters such as numbers and letters. The output of encoder 24 can be monitored to detect pulse interruptions indicating a left or right-hand physical limit has been reached. Alternatively, left-hand and right-hand limit switches (not shown) may be used at the extreme ends of platen 12 to limit the ultimate allowable travel of print head 10 to locations between the two limit switches. For example, physical engagement by print head 10 of the limit switches can actuate the limit switches. Encoder 24 can be of the type having a disc with light-interrupting means with two pairs of associated light-emitting diodes and photo-transistors to produce quadrature-related signals including an electrical pulse for each printed dot location, as described for example in copending U.S. patent application Ser. No. 766,243, entitled LATERAL POSITION CONTROL MEANS FOR DATA PRINTER HEADS, invented by Juan F. Velazquez and filed Feb. 9, 1977, issued Apr. 1, 1980 as U.S. Pat. No. 4,195,938, the disclosure of which is hereby incorporated by reference.

Figure 2:
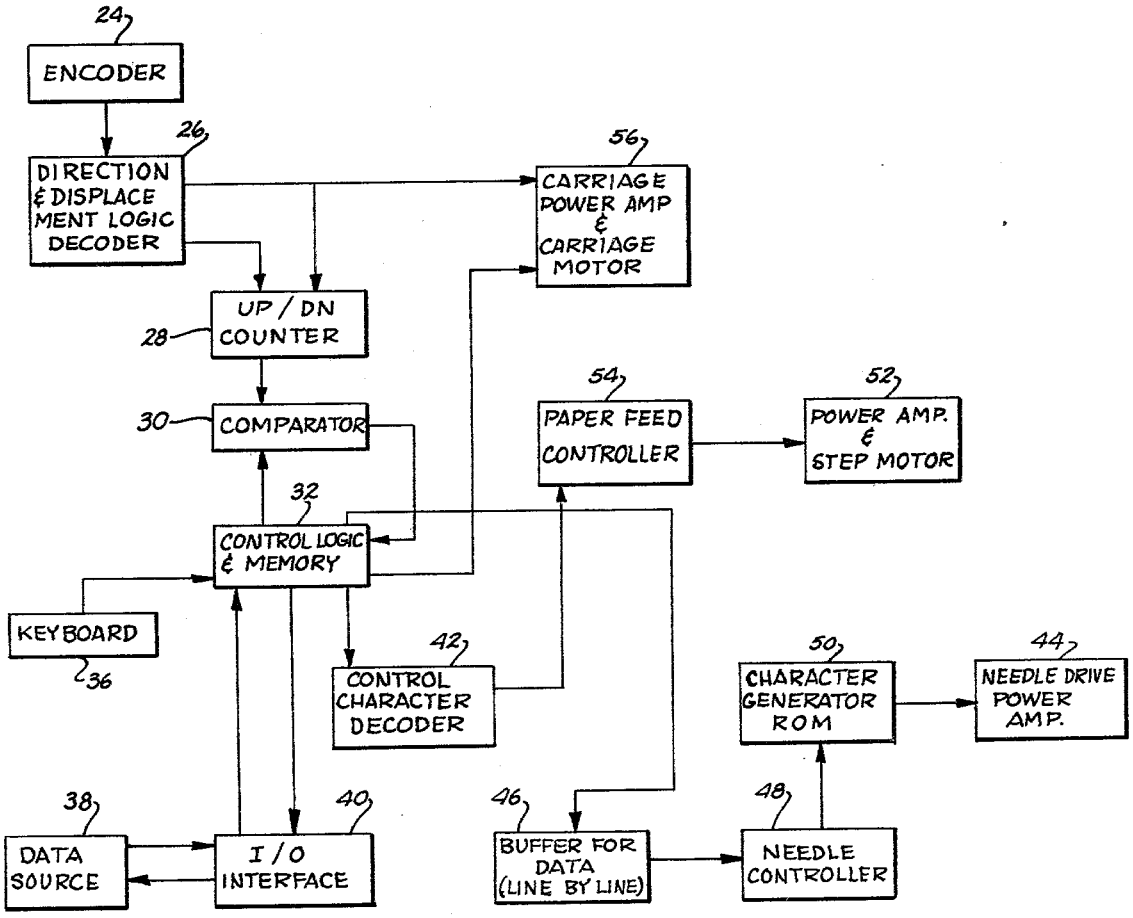
FIG. 2 is a functional block diagram of a printing machine control system in accordance with an embodiment of this invention.

Referring to FIG. 2, a functional block diagram of a printing machine control system in accordance with an embodiment of this invention includes the aforementioned encoder 24, which is coupled to control logic and memory, designated by the numeral 32, through the sequential connection of a direction-and-displacement logic decoder 26, an up-down counter 28, and a comparator 30. The control logic and memory 32 also has inputs from a keyboard 36, and a data source 38, through an input-output interface 40. Control logic and memory 32 has outputs coupled to a carriage drive servo, power amplifier, and carriage motor unit or assembly 56 for controlling lateral movement of print head 10, to a buffer 46 for controlling flow of data to activate print head needles, to comparator 30 for supplying a desired lateral location for print head 10, and to interface 40 for controlling flow of data from data source 38. Buffer 46 is connected to a needle-drive power amplifier 44 through the sequential connection of a needle controller 48 and a character generator read only memory 50. Control logic and memory 32 is connected to a power amplifier and step motor 52 through the sequential connection of a control character decoder 42 and a paper feed controller 54. Direction and displacement logic decoder 26 is coupled to up-down counter 28 and carriage drive servo, power amplifier, and carriage motor unit or assembly 56.

Carriage drive servo, power amplifier, and carriage motor 56 is coupled to receive an input from control logic and memory 32 and determines the right and left movement of the print head 10 along the platen 12. The data which is eventually printed on the printing surface by print head 10 is supplied at data source 38. A typical source can be, for example, a magnetic memory containing information describing a particular paragraph to be printed. Interface 40 is adapted to adjust the level of the voltage signals from data source 38 to the level required by control logic and memory 32. For example, if control logic and memory 32 uses transistor logic, voltage applied to logic and memory 32 should be in the range of about 0 to 5 volts. In addition to translating voltage levels, interface 40 can also match impedance levels and filter out noise from data source 38. Voltage signals transmitted from interface 40 to data source 38 indicate the availability of interface 40 to receive data.

Paper feed controller 54 applies a voltage signal to power amplifier and step motor 52 causing the paper 13 to move one increment. In one embodiment of this invention, twelve incremental steps are required to move the paper 13 one line. Paper feed controller 54 includes logic and memory circuits for determining the last instructions sent to power amplifier and step motor 52 and for determining how many more increments are required to complete one line. Control character decoder 42 decodes characters from data source 38 which are not to be printed but, instead, are used to indicate such actions as line feed, carriage return, horizontal tab and various other control functions. For example, a single character representing the spacing of a certain number of lines is converted into an order for a discrete number of line spacings equalling the desired vertical distance. Paper feed controller 54 receives voltage signals indicating how many vertical line spacings are desired and sends to power amplifier and step motor 52 voltage signals indicating the number of incremental steps required to equal the desired number of vertical line spacings.

Needle controller 48 operates in a manner analogous to paper feed controller 54. A character can have for example, 10 vertical segments much the same as each line can have a plurality of horizontal segments. Needle controller 48 has an output of voltage signals representing the next character to be printed and the vertical column in which the character is to start. Needle controller 48 has an input from buffer 46 which initiates printing action when print head 10 is in the desired lateral position.

The connection from decoder 26 to carriage drive servo, power amplifier, and carriage motor 56 sends pulses indicating movement of the print head 10 to a carriage servo (part of unit 56) controlling the carriage motor (also part of unit 56). Typically, the carriage servo expects a given pulse repetition rate and controls the carriage motor to either increase the speed of movement of print head 10 if the pulse repetition rate received is too low or decrease movement of print head 10 if the pulse repetition rate received is too high. The pulse repetition rate is also used to stop the driving of print head 10 by carriage drive servo, power amplifier, and carriage unit motor 56. That is, if a given time period of say, for example, 50 milliseconds, passes without pulses indicating movement of print head 10 when movement of print head 10 is expected, such as during printing, the carriage motor shuts down because it is assumed that print head 10 has reached a lateral limit of travel or has been laterally jammed. It can be appreciated that the carriage servo controlling the carriage motor can be set to produce a variety of different speeds of lateral movement. Further, the carriage motor is typically operated by applying a normal drive voltage to the carriage motor and the acceleration or slowing of the carriage motor is then determined by the motor characteristics.

In general, margin and line spacing setting and variation (for example as shown in FIG. 1) is initiated by an operator at keyboard 36 and implemented in the printing machine through control logic and memory 32. That is, the desired performance of the printing machine is controlled through keyboard 36. Information about the actual condition or position of the print head 10 is necessary for control logic and memory 32 to develop voltage signals for obtaining desired performance of the printing machine (i.e., movement of the print head 10) and is supplied by encoder 24, which in fact monitors movement of print head 10. Needle controller 48 and the control logic and memory 32 coordinate printing action.

Control logic and memory 32 can include, for example, programmable read only memories (PROM), random access memories (RAM), microprocessor chip and input/output devices (not specifically enumerated) which transmit developed voltage signals to and from other components such as the print head assembly, the keyboard 36, the paper advance, the encoder assembly and all switches (not specifically shown). An example of such a switch is a contact which is open when there is paper in the printer and closed when there is no paper. Advantageously, control logic and memory 32 also has an operator-accessible configuration switch (not specifically enumerated) which enables the operator to select a single or a double line feed and set a default form length for use when the form length has not been otherwise defined. That is, the configuration switch would alter the voltage signal sent to paper feed controller 54 to change the paper feed. An example of a microprocessor chip for use in implementing control logic and memory 32, for example, is an Intel 8080 microprocessor in combination with an Intel 8224 clock generator and driver. The clock generator can be driven by, for example, an 18 MHz crystal-controlled oscillator (not specifically illustrated) and provides the timing and control signals for the internal operation of the Intel 8080 microprocessor.

The horizontal position of print head 10 at each position along platen 12 is described by a binary number corresponding to a single dot position along platen 12. Thus, one dot can be printed at each discrete binary address. Whenever a printing machine in accordance with an embodiment of this invention is energized for operation, print head 10 is assigned, by control logic and memory 32, a given arbitrary address number larger than the total number of dot positions along platen 12. That is, a portion of the memory of control logic and memory 32 receives and stores binary bits representative of a print head 10 address larger than the total number of dot positions along platen 12. Initially, such information can be provided by an operator at keyboard 36. Print head 10 is then slewed slowly to the right, for example, and one bit, or binary unit, is added for each dot position traversed (in accordance with encoder pulses) until a right side limit is reached. As already noted, the right side limit can be indicated by an absence of encoder pulses for a period of time such as 50 milliseconds or limit switches which are actuated by the physical presence of print head 10 and complete a circuit indicating movement of print head 10 to the right must be stopped. The advantage of detecting a pause or a "time out " in the encoding pulse is that lateral jamming of print head 10 can also be detected at locations other than the lateral limits. Slewing is caused by a single output from control logic and memory 32 to the carriage drive servo, power amplifier and carriage motor 56, for actuating carriage drive servo, power amplifier and carriage motor 56 to move print head 10 to the right. When the limit is reached, a signal is applied to control logic and memory 32 which in turn applies a signal to carriage drive servo, power amplifier and motor 56 causing print head 10 to stop moving. The position is stored as the right side limit position. Print head 10 is then slowly slewed to the left and one bit is subtracted for each dot position traversed until a left-side limit is reached. The binary number address of print head 10 when it is located at the left-side limit is used as a fixed reference point for all lateral positions of print head 10 along platen 12. The distance between the left and right side limit positions is then computed and thus determines the number of characters which can be printed in the established platen width.

The logical signal processing of the output of encoder 24 by direction and displacement logic decoder 26 is more fully described in the aforementioned copending application Ser. No. 766,243 filed Feb. 9, 1977. Briefly, the voltage level of one of the signal outputs of direction and displacement logic decoder 26 establishes the sign (i.e., direction of print head 10) of the voltage pulses (i.e., incremental distance traveled by the print head 10) of the other of the signal outputs of decoder 26. Voltage signals sent from counter 28 to comparator 30 represent binary numbers indicating the actual location of the print head 10 along the platen 12. Comparator 30 also receives voltage signals from control logic and memory 32 representing the binary number address of the location where the print head 10 is desired to be located by the operator. Comparator 30 compares the voltage signals representing the actual location of the print head 10 with the voltage signals representing the desired location of the print head 10 and generates voltage signals representing the difference between the two locations. That is, the output of comparator 30 is a voltage signal representing the position from which the distance from the actual location to the desired location of the print head 10 is determined in the control logic and memory 32.

Lateral position addresses for print head 10 are also used in the process of determining whether the next sequential data line should be printed forward or backward to minimize printing time. In so doing, the data to be printed is compiled in whole lines in buffer 46, allowing for determination of whichever print direction will optimize throughput. The flow of printable data from data source 38 to buffer 46, which stores a whole line of data, for example 132 characters, is governed by the control logic and memory 32. Until buffer 46 is filled or other instructions are received, line compilation prevails as the primary processing activity of the printing machine before actual printing. An example of buffer 46 is a random access memory. The print head address at the particular location where the preceding printed line happens to end (since each line may well begin or end at a place other than the extreme left margin or the extreme right margin) is compared to the address for the beginning character of the next data line and also to the address of the ending character of the next data line. The distance from the print head 10 to the beginning character of the data line is computed by finding the difference between the address of the print head 10 and the address of the beginning character of the data line. Similarly, the distance from the print head 10 to the ending character of the data line is computed by finding the difference between the address of the print head 10 and the address of the last character of the data line. The print head 10 is then moved to the location of the closest such character, at the beginning or end of the next data line, to print in forward or reverse sequence depending upon whether the first or last character is closest.

A conventional drive motor, such as a step motor, driven by an appropriate power amplifier (together shown as unit 52) is mechanically coupled to the pin-feed drive element 20 (which may also be a tractor device or friction feed mechanism) such that the power amplifier and step motor 52 actuates the pin-feed drive element 20 or other paper-advance component to vertically advance printing paper 13 in relation to print head 10. The number of steps that the power amplifier and step motor 52 drives the paper-advance device after a line of data has been printed determines the vertical spacing to the next line to be printed. For example, in one embodiment, twelve steps are used to obtain a six line-per-inch density and nine steps are used to obtain an eight line-per-inch density. In the preferred embodiment, a normal line feed (one-sixth of an inch) is comprised of twelve paper-advance steps and takes approximately thirty milliseconds of execution time. A normal line feed refers to the amount of vertical movement of the printing surface for each line of printed data. If double line feed is enabled, a line feed operation causes a twenty-four step paper-advance motion in approximately forty-eight milliseconds.

Following is a table showing the response of a data printing machine in accordance with the foregoing to actuation of different particular keys on keyboard 36 (the particular keys not being specifically shown in the drawing but to be understood as individual keys in the keyboard 36):

| KEY | SET FORM STATE | STOP STATE | RUN STATE |
|---|---|---|---|
| Top of Form | Any "Top of Form" entry in the set state causes the page line count to be reset to zero. A pair of depressions defines the form length. The form length definition is the number of lines of paper advance resulting from the use of the LINE FEED key between the two most recent TOP OF FORM entries. A zero count is not valid. | Machine advances to next Top of Form | Machine stops at next Top of Form |
| Vertical Tab | Uses page line count as VERTICAL TAB location. If | Go to next Vertical Tab position. | Stop at next Vertical Tab position. |

-continued

| KEY | SET FORM STATE | STOP STATE | RUN STATE |
|---|---|---|---|
| | a tab exists at that line, it is cleared. A depression of the Vertical Tab Key directly after a Top of Form entry causes all vertical tab locations to be cleared. | | |
| Line Feed | Advance paper in Line Feed units until key is released. A normal line feed (1/6 inch) is comprised of 12 paper advance steps and takes approximately 30 ms. to execute. If a double line feed is enabled, a line feed operation causes a 24 step paper advance in approximately 48 msec. Paper advance begins with slow movements in single unit increments and gradually accelerates to slew speed. Motion stops when the key is released. | Go to next line. | Stop at next line feed. |
| LEFT | Move print head left until key is released or limit encountered | Go to left side of platen | Move Left-Hand Margin left one dot position |
| RIGHT | Move print head right until key is released or limit encountered | Go to right side of platen | Move Left-Hand Margin right one dot position |
| UP | Subtract one step from next Line Feed operation | NONE | Subtract one step from next Line Feed operation |
| DOWN | Add one step to next line feed operation | NONE | Add one step to next Line Feed operation |
| LEFT MARGIN | Save print head location as Left-Hand Margin Position | Go to soft Left-Hand Margin position | NONE |
| SET FORM | Move print head to left side and permit set-up | Move print head to load position and go to SET FORM state | NONE |
| RUN | Initiate printing and go to RUN state | Initiate printing and go to RUN state | NONE |
| STOP | Stop any print head motion and go to STOP state | Stop any print head and paper advance motion | Suspend printing, Stop motion and go to STOP state |

In the above table, three operational states of the printing machine are listed along the horizontal axis and examples of keys on the keyboard 36 are listed along the vertical axis. The three machine states, "set form", "stop" and "run", are mutually exclusive, and each state defines the printer condition as a result of operator keyboard entries and determines the effect of, or a printer response to, succeeding keyboard entries. Accordingly, a key can be used to initiate different, although related, printer responses dependent upon the printer state, effectively expanding the number of key entries available to the operator.

In general, the "set form" state permits the operator to input horizontal and vertical positional information, by operating the appropriate keys in the keyboard 36. Such information is used to control horizontal movement of the print head 10 and vertical movement of the printing surface. For example, in a particular printing operation this information may include a left-hand margin location, top of form location, form length specification and vertical tab locations. To facilitate a set-up procedure in which horizontal or vertical locations can be efficiently established, the capability is provided to cause print head or paper-advance motion in incremental steps for relatively slow motion, or in a continuous movement for relatively fast motion. The operator can choose the speed of movement of print head 10 by either a momentary depression or a continuous depression of a key, such as LEFT, causing print head movement. The acceleration of the print head 10 is determined by the print head motor characteristics. However, the final slewing speed of print head 10 may be chosen to be equal to the printing speed of print head 10 as controlled by carriage drive servo, power amplifier, and carriage motor 56. That is, the voltage applied to carriage drive servo, power amplifier, and carriage motor 56 by actuation of keyboard 36 (e.g., by actuation of the LEFT or RIGHT key 36*g*, 36*e* can be of the same magnitude as the voltage applied to carriage drive servo, power amplifier, and carriage motor 56 during normal printing, which is determined by setting of the servo (not shown) controlling carriage drive servo, power amplifier, and carriage motor 56 in relation to the pulse repetition rate received from decoder 26. Print head motion or paper movement in the "set form" state continues as long as the respective key is depressed (or until a limit is encountered), and is preferably characterized by a continuing motion rate acceleration from slow, small discrete increments to faster slew speeds.

When set-up is complete, the operator may advance the printer state to "stop" or "run" by depressing a stop key 36*h* or a run key 36*i*. As a result of either action, the positional information inputed in the "set form" state is fixed and can only be changed, except for fine adjustments in the "run" state, by returning to the "set form" state. For example, to change a left-hand margin position, four sequential operator actions are necessary:

(a) Enter the "set form" state by depression of the "Set Form" key 36*a*.

(b) Move the print head 10 to a particular position on the paper corresponding to the desired margin setting by using the appropriate key (LEFT and RIGHT keys 36*g* and 36*e* respectively).

(c) Indicate setting of the new desired margin position by depression of the "left-hand margin" (Left Margin) key 36*b*.

(d) Enter (or register) the Left Margin entry by initiating either the Stop or Run state, by depression of the "Stop" or "Run" key 36*h*, 36*i*, respectively.

This sequence is advantageous because a new left-hand margin is not effective until steps a, b, c and d have been completed. The previously set or assumed left-hand margin is not lost until the new left-hand margin is set, or, in other words, there is no time when a left-hand margin is not available to the printing machine. Advantageously, a left-hand margin is assumed by the printer if the operator makes no left-hand margin entry. That is, a left-hand margin can be included in control logic and memory 32 and can be used at all times a different left-hand margin is not entered at keyboard 36 by the operator.

Inward of the left and right physical extremes of print head movement "soft limits" are established to stop physical movement of the print head 10 past these "soft limit" positions. As noted above, upon the first depression of the "set form" key 36*a*, the print head 10 is moved to the left until the left side physical limit is encountered. An offset of approximately a three-character distance is added to the left limit dot position and the result is stored as the operative margin position, i.e., the location of the left edge of ensuing printing (termed a "soft limit" position). More specifically, the location of the print head 10 expressed as a binary number address is stored when the print head 10 is positioned at the left side limit. To this binary number address is added a binary number representing the horizontal distance required to contain approximately three characters. The resulting binary number address represents the soft limit position. Any later action which causes print head travel to the left edge will result in termination of motion left at the soft limit position. Similarly, a soft limit is established for the right edge of the printer by subtracting approximately a three-character distance from the physical right side limit dot position on the first encounter with that limit. A recurring excursion of the print head 10 to the physical limits may indicate either drift due to digital errors or a complete loss of control as a result of a hardware malfunction or other such major problem.

In the STOP state, the printer is considered to be "off line". No changes to set-up conditions are permitted regardless of any key depressions as long as the printer is in the stop state. The operator has the assurance that despite print head or paper-advance motion initiated by a specific key entry, no parameters established in the set form state or fine adjusted in the run state will be altered or lost. Operator keyboard entries, in general, cause motion horizontally or vertically to set location with a single key depression. Printer functions in the stop state are intended to facilitate loading of paper without loss or change of set-up data.

The run state is the "on line" condition of the printer. In this machine state, two types of functions can be commanded from the keyboard 36: (1) fine adjustment of horizontal and vertical print position, and (2) conditional or immediate stop of printer activity. Fine adjustment, consisting of only very limited increments such as (for example) one dot position left or right or one paper advance step up or down for each key depression, allows minor changes to horizontal and vertical positioning established in the set form state. In particular, the left-hand margin can be moved to the left or to the right and the new location of the left-hand margin retained for all future data lines. Fine adjustments of one dot or one paper-advance step (per key depression) are not applied to the line being printed at the time the adjustments are entered and positional changes are realized on the next printed line.

FIGS. 3–12 illustrate by way of logical flow diagrams the control sequences commanded by the control logic and memory 32 upon actuation of the various keys in keyboard 36, the particular key involved being labeled and shown as the first box in each logical flow diagram. The machine states which are considered in the flow diagrams are indicated by zero ($\phi$) for "power initiated", one (1) for "set", two (2) for "stop" and three (3) for "run". In the logical flow diagrams the symbol "Y" indicates a yes answer and "N" indicates a no answer. The logical flow sequence in each case concludes in an idle condition which means the machine is ready to accept another instruction, i.e., the actuation of another button on keyboard 36. When the power is turned on, an arbitrary value or address number is assigned to the current print head position, and the margins, vertical spacing and length of the form to be printed are assigned arbitrary or default values which are used unless otherwise changed.

Figure 3:
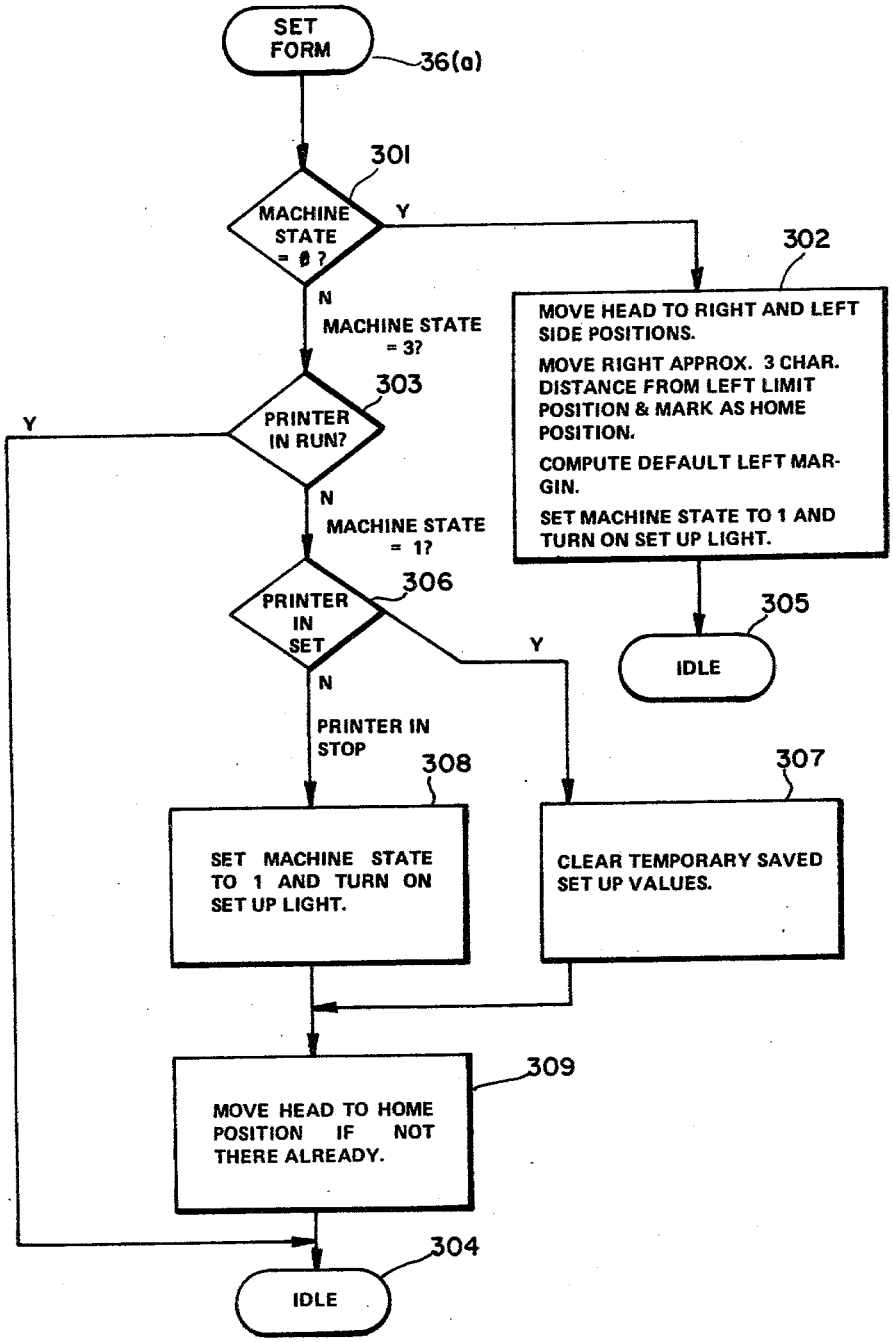
FIG. 3 is a functional flow diagram of a machine in accordance with an embodiment of this invention when SETUP (or SETFORM) state is initiated.
Figure 4:
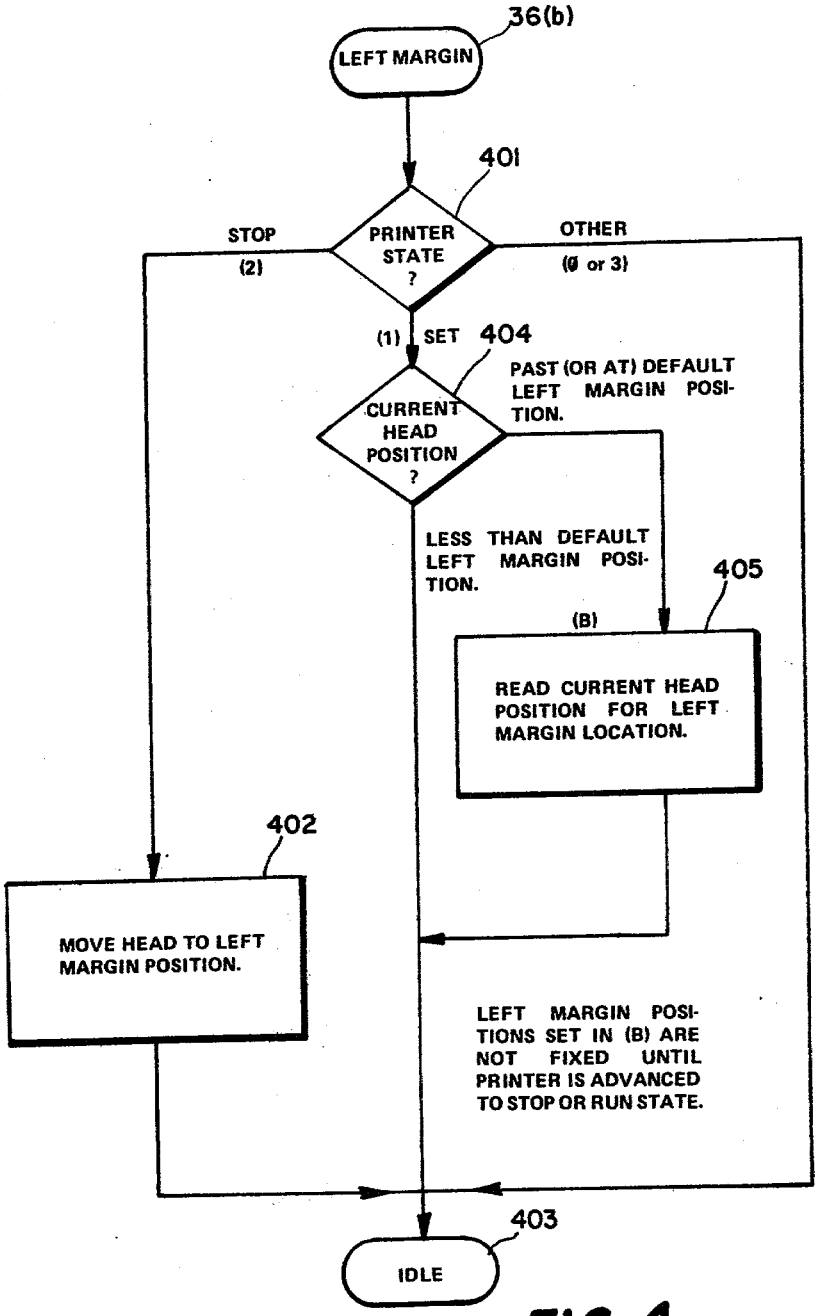
FIG. 4 is a functional flow diagram of a machine in accordance with an embodiment of this invention when the LEFT-HAND MARGIN function is initiated.
Figure 5:
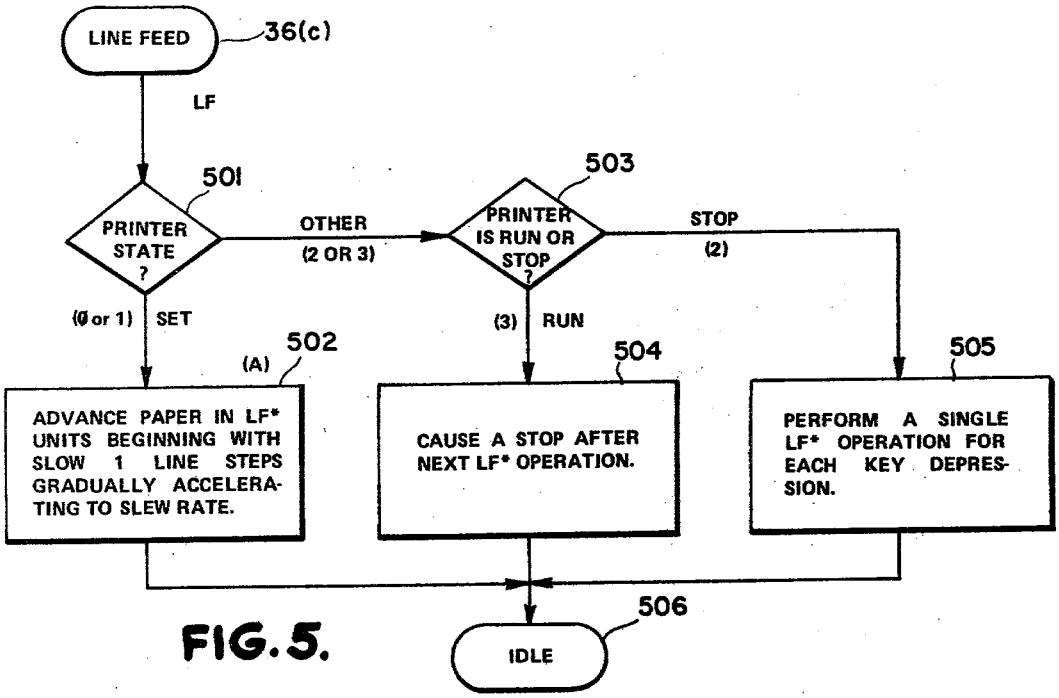
FIG. 5 is a functional flow diagram of a machine in accordance with an embodiment of this invention when the LINE FEED function is initiated.
Figure 6:
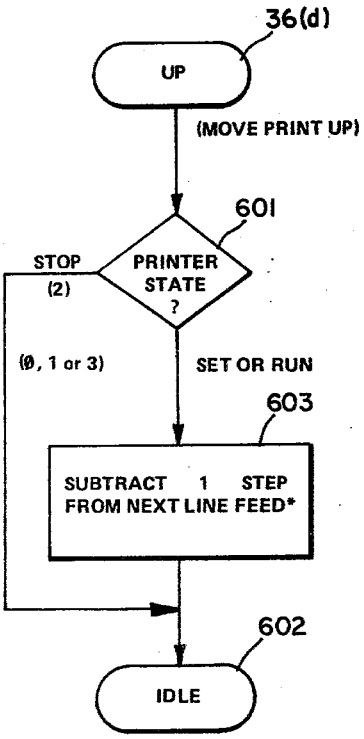
FIG. 6 is a functional flow diagram of a machine in accordance with an embodiment of this invention when the UP function is initiated.
Figure 7:
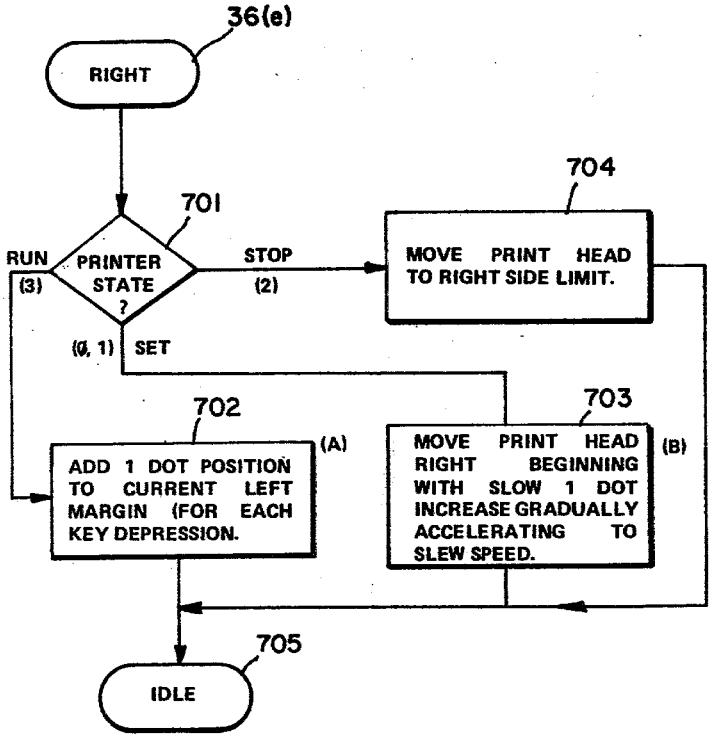
FIG. 7 is a functional flow diagram of a machine in accordance with an embodiment of this invention when the RIGHT function is initiated.
Figure 8:
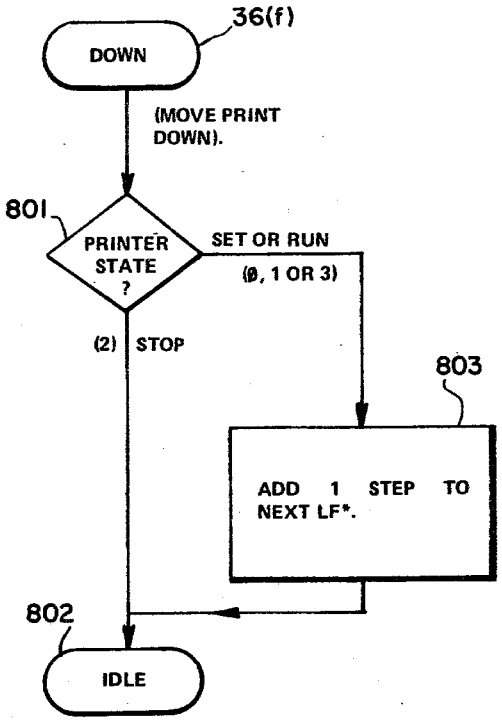
FIG. 8 is a functional flow diagram of a machine in accordance with an embodiment of this invention when the DOWN function is initiated.
Figure 9:
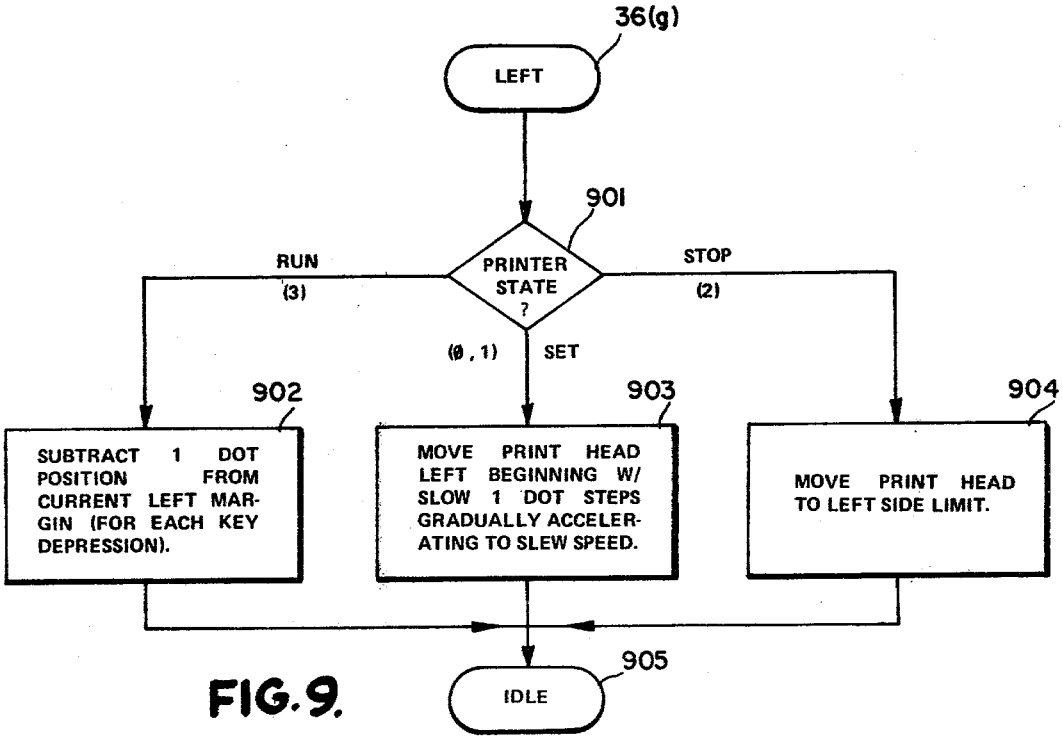
FIG. 9 is a functional flow diagram of a machine in accordance with an embodiment of this invention when the LEFT function is initiated.
Figure 10:
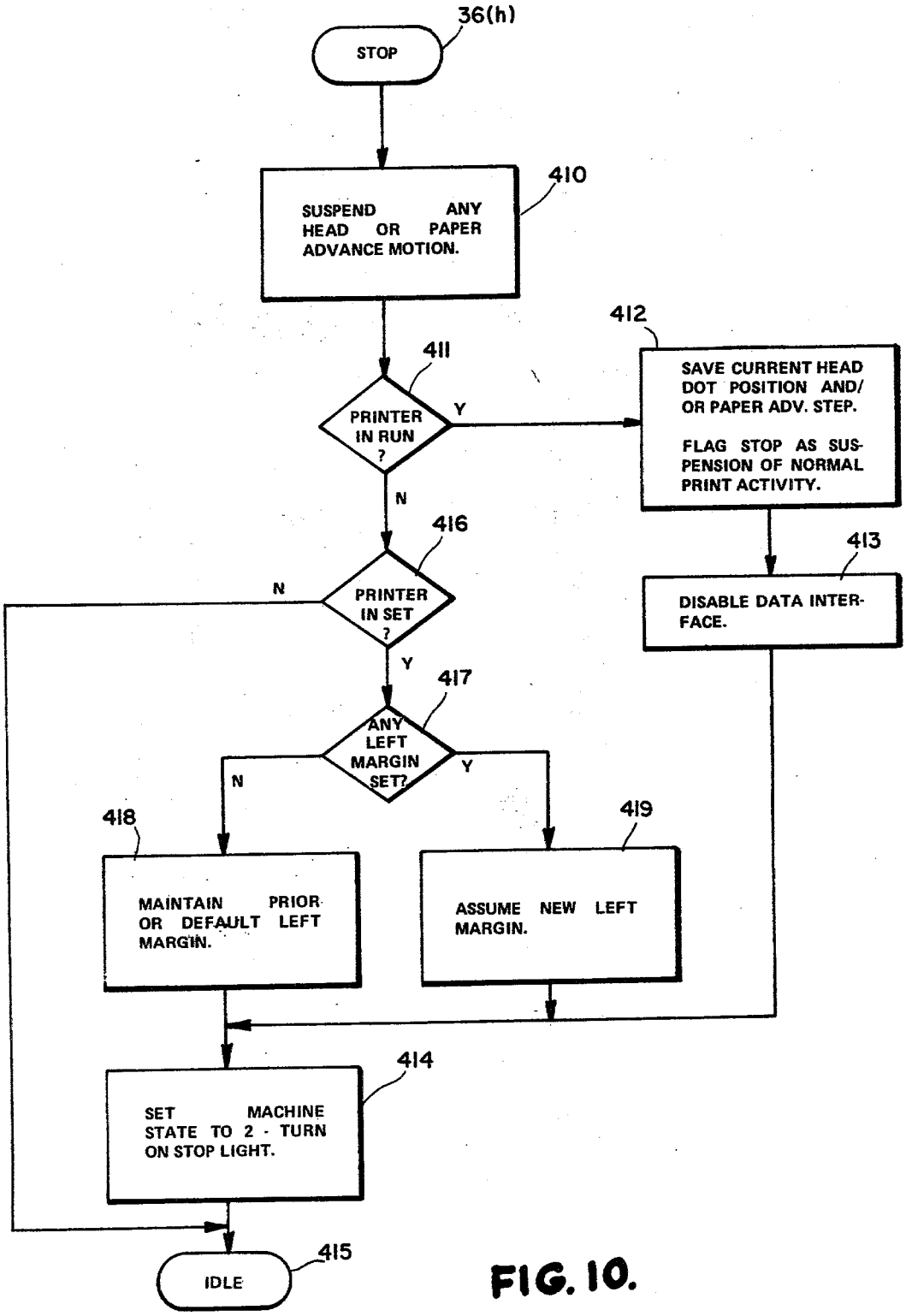
FIG. 10 is a functional flow diagram of a machine in accordance with an embodiment of this invention when the STOP state is initiated.
Figure 11:
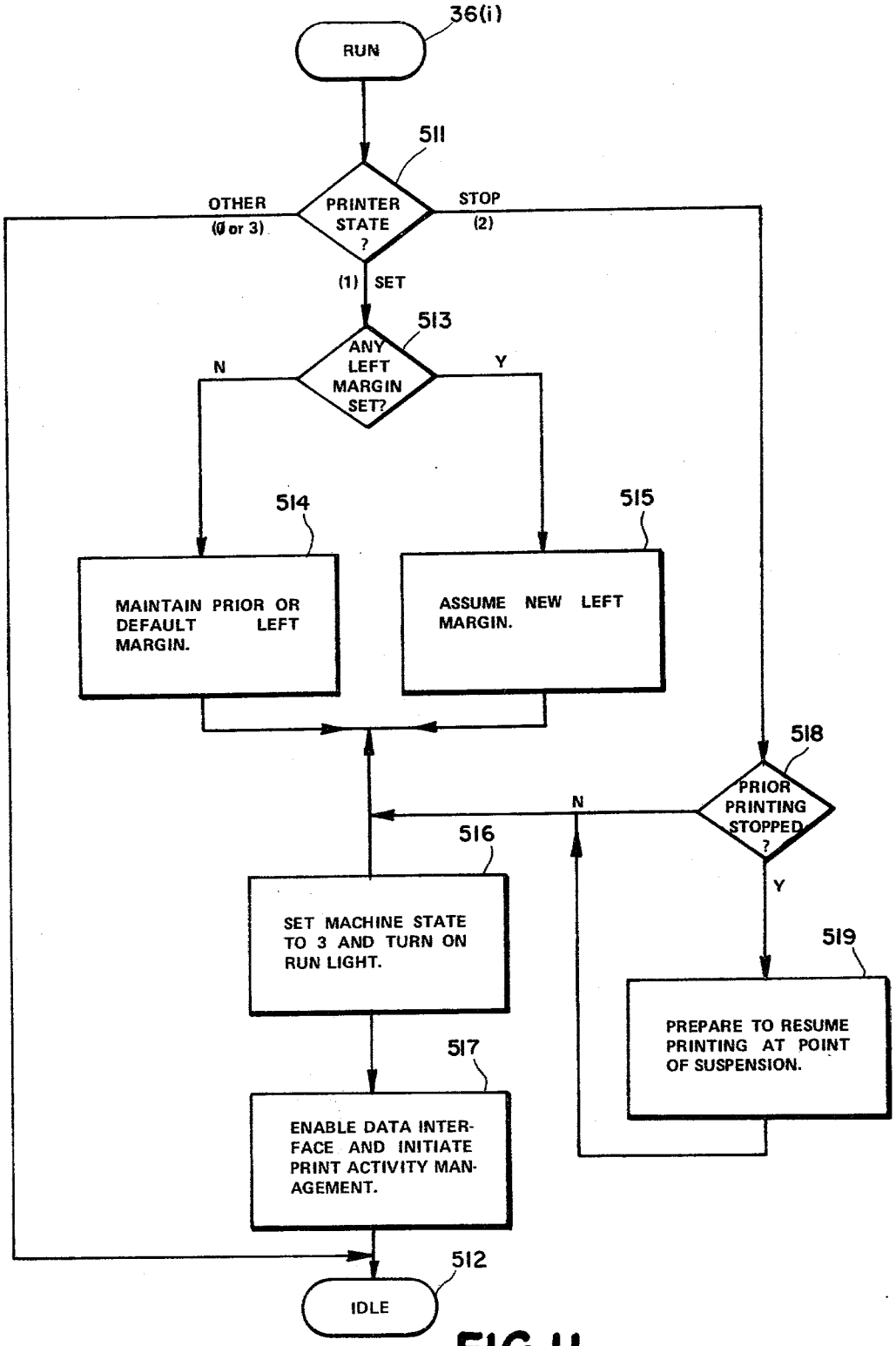
FIG. 11 is a functional flow diagram of a machine in accordance with an embodiment of this invention when the RUN state is initiated.
Figure 12:
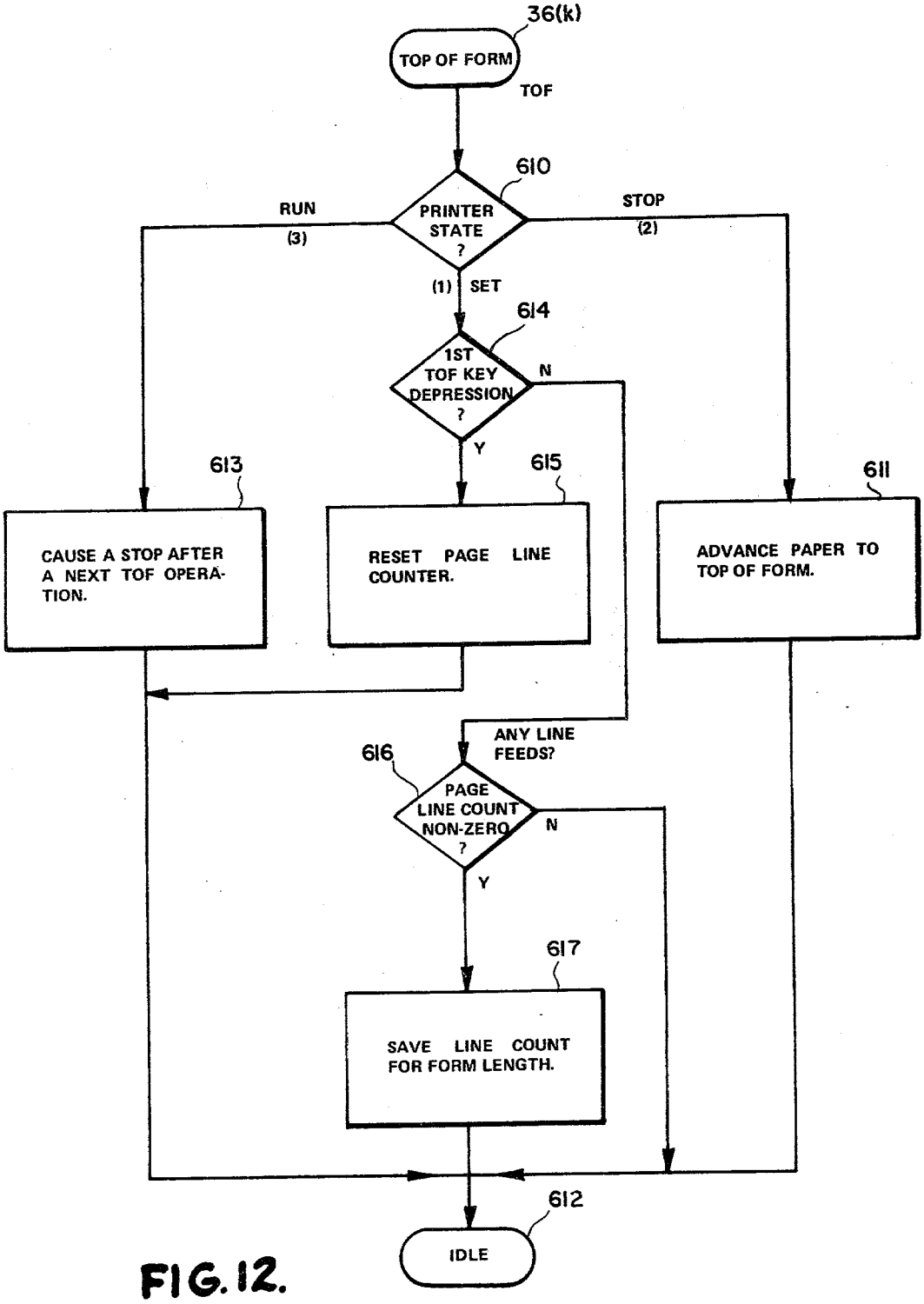
FIG. 12 is a functional flow diagram of a machine in accordance with an embodiment of this invention when the TOP OF FORM function is initiated.

As shown in FIG. 3, a logical process upon activation of the set-up (or sometimes referred to as set-form) state includes first questioning whether the machine state is in state zero, and if not, in state three, and if not, in state one. The left margin and vertical control parameters which are entered during this logical flow are not fixed until the printer is advanced to either a stop or run state. The particular left-hand margin established in this logical flow is a "soft" left-hand margin a three character distance inward (or to the right) of the physical left limit position. Referring to FIG. 4, initiating the left margin function causes interrogation of the machine state and action upon the left-hand margin depending upon the state of the machine. Referring to FIG. 5, when the line feed function is initiated the printer state is interrogated and, for example, if it is in the set condition the paper 13 is advanced until the line feed key 36*c* is released. Although typically each unit of line feed is the equivalent of single spacing, if desired, each unit of line feed can be the equivalent of double spacing which would occur where indicated by an asterisk (*). Further, paper motion indicated at block (A) continues until the key 36*c* is released, even if the out-of-paper switch (not shown) is set. Referring to FIG. 6, the logical flow of the "up" function is shown. In accordance with one embodiment of this invention, a normal line feed (at the point indicated by an asterisk [*]) is comprised of 12 paper-advance steps and the initiation of the "up" key 36*d* is limited to 12 sequential key depressions. An actuation of the "up" function subtracts one step from the next line feed, after which feed the number of steps returns to the initial value. In FIG. 7, when the "right" function is initiated and the machine is in the "run" state the added dot position (occurring at block [A]) to the left-hand margin is realized on the next printed line. When the machine is in the "set" state (occurring at block [B]) the head movement continues to the right until the "up" key 36*e* is released. When the machine is in the "stop" state the print head 10 is moved to the right side limit. FIG. 8 shows the logical flow of the "down" function and, as in FIG. 6, a normal line feed (occurring at asterisk [*]) is comprised of 12 paper-advance steps. Again, as the logical flow diagram shows, the particular action taken depends on the machine state. In a "set" or "run" state actuation of the "down" function adds one step to the next line feed, after which feed the number of steps returns to the initial value. FIG. 9 shows a logical flow upon actuation of the "left" function, which is analogous to the "right" function logical flow shown in FIG. 7. FIGS. 10 and 11 show the logical flow for the initiation of "stop" and "run" machine states respectively. The logical flow diagram for the "top of form" function is shown in FIG. 12 and is advantageously used in conjunction with a printing surface which is separated into sequentially coupled repetitive forms (not shown). Basically, in the "set" state information is entered about the form length in lines, in the "run" state a stop is caused after the next top of form operation, and in the "stop" state the paper is advanced to the top of form position.

More particularly, relative to the control sequences initiated and controlled by the memory content and logical operation of the control logic and memory 32, referring to FIG. 3, actuation of the "setup" key 36*a* of keyboard 36 causes the control logic and memory 32 to initiate a logic function 301 which determines whether the machine is in a power-initiated state. If it is, the machine action proceeds, under control of the control logic and memory 32, with a logic function 302 wherein the action taken includes moving the print head 10 sequentially to the extreme right and left side positions, marking a home position at a distance of approximately three (3) characters from the left limit position, establishing a default left margin for use when no other left margin is entered by the operator, and then putting the machine into the set-up state. After the completion of function 302, the control logic and memory 32 goes to an idle control state 305. If the machine is not in the power-initiated state during function 301, the control logic and memory 32 initiates a logic function 303 which determines whether the printer is in the run state. If it is, the control process goes to an idle control state 304. If the printer is not in the run state, the control sequence goes through a logic function 306 which determines whether or not the printer is in the set state. If it is, the control unit initiates a logic function 307 and clears setup values which were temporarily saved. If the output of function 306 is negative, the logic sequence proceeds to a logic function 308, where the machine is put into the set state. The logic flow from functions 308 and 307 is to a logic function 309 wherein the print head 10 is moved to a home position. The logic flow from function 309 is to an idle condition 304, thereby putting the machine into an idle state.

Referring to FIG. 4, actuation of the "left margin" key 36*b* of keyboard 36 causes an interrogation of the printer's state by a logic function 401. If the printer is in stop state, the control sequence goes through a logic function 402 wherein the print head 10 is moved to the left margin position, and the control process then proceeds to an idle condition 403, wherein the machine is in an idle state. If the printer is in set state, the control process initiates a logic function 404 which determines whether the current print head position is past, or at, the default left margin position. If so, the control sequence continues to a logic function 405 wherein the current print head position is taken to determine the left margin location, and the control sequence then goes to idle condition 403. If the current print head position is less than the default left margin position, the control process goes directly to idle condition 403. Similarly, if the logic function 401 indicates a state other than stop or set, the control sequence goes directly to idle condition 403.

Referring to FIG. 5, actuation of the "line feed" key 36*c* on keyboard 36 causes a logic function 501 to interrogate the printer state. If the printer is in set state, or power initiated, logical processing goes to logic function 502 wherein paper 13 is advanced in one-line steps. If the output of logic function 501 is stop or run, the logical processing goes to a logic function 503 wherein the printer is interrogated to determine whether it is in the stop or the run state. If it is in the run state, the processing goes to a logic function 504 which causes a stop after the next line feed operation. If the logical output of logic function 503 indicates the stop state, then logical processing goes to a logic function 505 wherein a single line feed operation is performed for each key depression of the line feed key 36*c*. The outputs of logic functions 502, 504, and 505 all go to an idle logic state 506, wherein the machine is put into its idle state.

Referring to FIG. 6, after the "up" button 36*d* is depressed on keyboard 36, a logical function 601 interrogates the printer state. If the printer is in stop state, then logical processing goes to an idle logic state 602. If the printer state is power-initiated, stop or run, logical processing goes to a logic function 603 wherein one step is subtracted from the next line feed. The output of logic function 603 goes to idle logic state 602.

Referring to FIG. 7, depressing the "right" key 36*e* of keyboard 36 causes logic function 701 to interrogate the printer state. If the printer is in its "run" state, logical processing goes to a logic function 702, wherein one dot position, or space is added to the current left margin position for each key depression. If the printer is in its set or power-initiated state, logical processing goes to a logic function 703, wherein the print head 10 is moved to the right at one-dot increments with increasing speed. If the output of function 701 is "stop", then logical processing goes to logic function 704 wherein the print head 10 is moved to the right side limit. The outputs of logic functions 702, 703 and 704 are all continued to an idle logic state 705.

Referring to FIG. 8, depressing the "down" button 36*f* on keyboard 36 causes the logical processing to institute a logic function 801, which interrogates the printer state. If the printer state is "stop", logical processing goes to an idle logic state 802. If the printer state is other than "stop", logical processing goes to a logic function 803 wherein one step is added to the next line feed. The output of function 803 is coupled to an idle logic state 802.

Referring to FIG. 9, "left" key 36*g* of keyboard 36 triggers a logic function 901 which interrogates the printer state. If the printer is in its "run" state, logical processing goes to a logic function 902 which subtracts one-dot position from the current left margin for each key depression. If the printer is in its "set" or power-initiated state, logical processing goes to a logic function 903, which moves the print head 10 to the left beginning with discrete one-dot steps and gradually accelerating such steps to slow speed. If the output of logic function 901 is "stop", logical processing goes to a logic function 904 wherein the print head 10 is moved to the left side limit. The outputs of logic functions 902, 903 and 904 are all coupled to an idle logic state 905.

Referring to FIG. 10, depressing the "stop" key 36*h* of keyboard 36 causes a logic function 410, which suspends any print head or paper advance motion. Next, the logical processing goes to a logic function 411, which questions whether the printer is in the "run" state. If the answer is yes, logical processing goes to a logic function 412 which saves the current print head position and removes the suspension of normal print activity. The output of logic function 412 is coupled to a logic function 413 which disables the data interface. The output of logic function 413 is coupled to a logic function 414 which sets the machine to its stop state. The output of logic function 414 is coupled to an idle logic state 415. If the output of logic function 411 indicates that the printer is not in "run" state, a logic function 416 interrogates the printer, to determine if it is in "set" state. If the printer is not in the "set" state, the logical processing goes to an idle logic state 415. If the printer is in "set" state, the logic function 417 interrogates to determine whether there are any left margins set. If there are not, a logic function 418 maintains the prior or default left margin and then proceeds to logic function 414. If there are left margins set, logical processing goes to a logic function 419 and assumes a new left margin, and the logical processing then goes to logic function 414, whose output is coupled to idle logic state 415.

Referring to FIG. 11, actuating the "run" key 36*i* of keyboard 36 causes a logic functions 511 to determine the existing printer state. If the printer is in power-initiated or "run" state, logical processing goes directly to an idle state 512. If the printer is in "set" state, a logic function 513 interrogates whether any new left margin has been set. If there is none, logical processing goes to a logic function 514 which maintains a prior or default left margin. If there is a new left margin set, logical processing goes to a logic function 515 which assumes the new left margin. The output of either logic function 514 and 515 goes to a logic function 516, which sets the machine state to "run" and turns on an appropriate indicator (not shown) (i.e., the "run light"). Logical processing then proceeds to a logic function 517 which enables the data interface and initiates print activity management. The output of logic function 517 is coupled to the idle state 512. If the output of the initial logic function 511 indicates a "stop" printer state, logical processing goes to a logic function 518 which determines whether prior printing has yet stopped. If prior printing has not stopped, logical processing goes to the aforementioned logic function 516. If prior printing has stopped, logical processing goes to a logic function 519, which prepares to resume printing at the point where printing was previously suspended. The output of logic function 519 is coupled to logic function 516, mentioned previously.

Referring to FIG. 12, depressing the "top of form" key 36*k* of keyboard 36 causes a logic function 610 to interrogate the printer state. If the printer is in "stop" state, logical processing proceeds with a logic function 611 which advances paper 13 to the top of the form and then goes to an idle processing state 612. If the output of logic function 610 indicates the printer is in a "run" state, logical processing goes to a logic function 613 which causes a stop after the next top of form operation. The output of logic function 613 is coupled to the idle processing state 612. If the output of logic function 610 is a "set" printer state, a logic function 614 questions if this is the first top of form key 36*k* depression. If the answer is yes, control processing goes on to a logic function 615 which resets the page line counter (not shown). The control processing then proceeds to the idle processing state 612. If the output of logic function 614 indicates no, a logic function 616 questions whether the page line count is non-zero. If the answer is no, logical processing goes to idle processing state 612. If the answer is yes, logical processing goes to logic function 617 and the line count for the form length is saved. The output of logic function 617 is coupled to idle processing state 612.

Figures 13, 14:
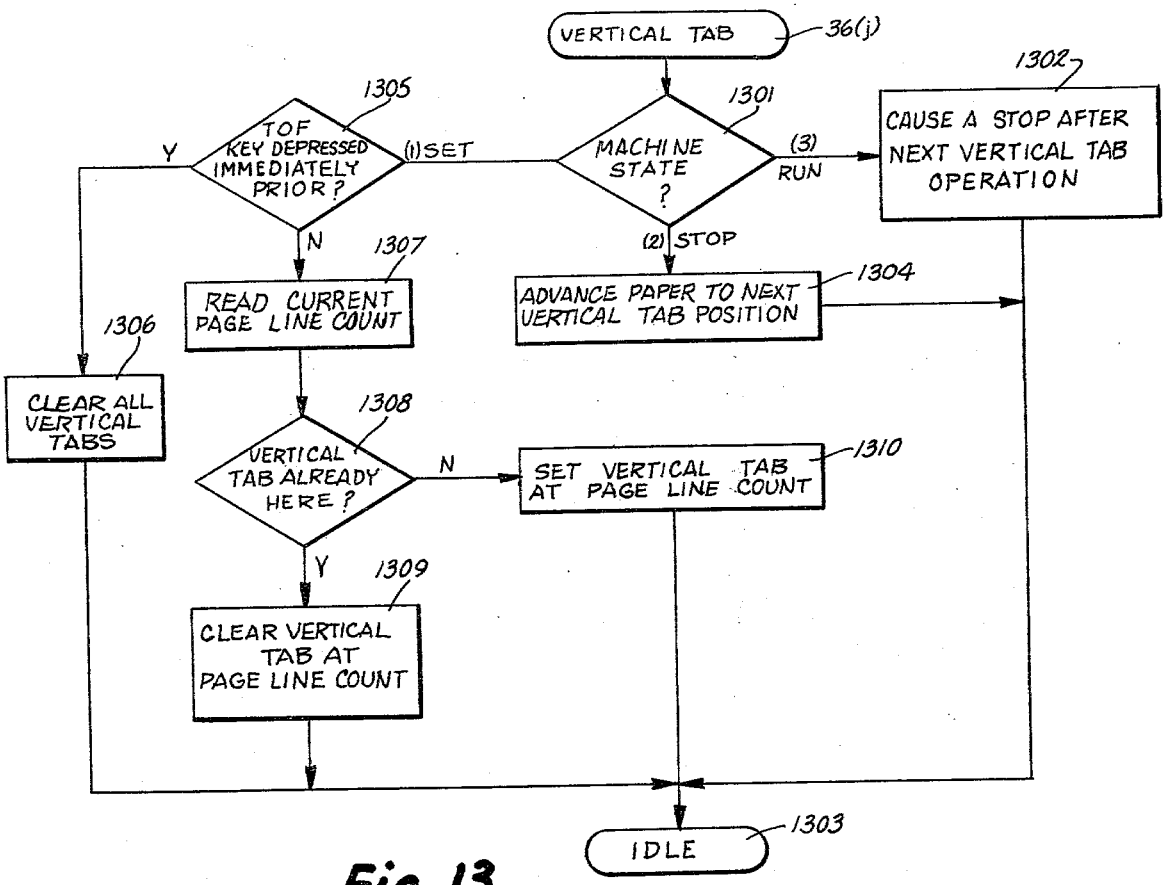
FIG. 13 is a functional flow diagram of a machine in accordance with an embodiment of this invention when the VERTICAL TAB function is initiated.
FIG. 14 is a top plan view of a keyboard in accordance with an embodiment of this invention.

Referring to FIG. 13, depressing "vertical tab" key 36*j* of keyboard 36 causes a logic function 1301 to interrogate the printer state. If the printer is in "set" state, logical processing proceeds with logic function 1305 which queries whether the "top of form" key 36*k* was depressed immediately prior to "vertical tab" key 36*j*. If the output of logic function 1305 indicates that "top of form" key 36*k* was so depressed, logic function 1306 clears all vertical tabs. If "top of form" key 36*k* was not so depressed, logical processing proceeds with logic function 1307 which reads the current page line count. Logic function 1308 then determines whether a vertical tab is already recorded for this page line count. If a tab already exists, logic function 1309 clears the tab. On the other hand, if a vertical tab does not exist, a tab is set by logic function 1310. If the output of logic function 1301 indicates that the printer is in "stop" state, logic function 1304 causes the paper to be advanced to the next vertical tab position. Finally, if the output of logic function 1301 indicates that the printer is in "run" state, logical processing continues to logic function 1302 which causes a stop after the next vertical tab operation. The output of logic functions 1302, 1304, 1306, 1309, and 1310 are all coupled to idle logic state 1303.

Various modifications and variations will no doubt occur to those skilled in the art to which this invention pertains. For example, the particular rate of incremental response of margin change or line spacing change can be varied from that disclosed herein. Similarly, the particular sequence of steps for establishing either a margin or a spacing between lines may be varied from that disclosed herein. These and all other variations which basically rely on the teachings through which this disclosure has advanced the art are properly considered within the scope of this invention.

The embodiments of the invention in which an exclusive property or privilege is claimed are defined as follows:

1. A control system for a data printer of the general type having at least one print head and means for holding printable stock in position relative to said print head for printing thereby, and including means for effectively moving the print head and printable stock relative one another for printing horizontally-aligned characters, said control system comprising:

at least one manually-actuable control key device and means acting in response thereto for producing different particular electrical signals representative of different particular locations in such horizontal alignment of characters;

margin-set means operatively coupled to said control key device and to said means for relatively moving said print head and printable stock, said margin-set means including means conditionable by said different particular electrical signals in response to selective control key actuation so as to index relative movement of said print head and printable stock by limiting ensuing printing to a defined horizontal area ending on opposite side extremities at different particular positions in said horizontal alignment of characters; and said conditionable means being condition-retaining for printing after initial control key actuation and being condition-alterable by subsequent different particular electrical signals produced upon at least one subsequent different control key actuation and representative of a different position along said horizontal alignment of characters; such that said indexing of relative print head movement may be changed by at least one subsequent control key actuation to a different position than that previously set by control key actuation, such subsequent control key actuation and resultant condition-altering of said conditionable means being operable independently of the position of said print head along said horizontal alignment of characters and during periods of relative print head movement as during printing by said data printer.

2. The control system of claim 1, wherein said manually-actuable control key device includes a control key and means coupled thereto for initiating said effective relative print head and printable stock movement upon actuation of said control key and for stopping such movement upon deactuation of said control key, and wherein said means for producing electrical signals representative of a particular position is operative to produce signals representative of a given particular position when said print head has been moved relative to said printable stock into alignment with said given particular position.

3. The control system of claim 2, wherein said means for producing electrical signals is operative to produce signals representative of any of a plurality of different given particular positions when said print head has been moved into alignment with a selected one such given particular position.

4. The control system of claim 3, wherein said means for producing electrical signals is so operative upon actuation of said control key device with said print head in said position of alignment.

5. A control system for a data printer of the general type having at least one print head and means for holding printable stock in position relative to said print head for printing thereby, and including means for effectively moving the print head and printable stock relative one another for printing vertically spaced horizontal lines of characters with a line spacing between successive lines of characters comprising a plurality of discrete individually variable vertical increments, said control system comprising:

a manually actuable control key device having at least one control key and means coupled thereto for producing electrical signals upon actuation of said control key; line-advancing means operatively associated with said means for moving said print head and printable stock, for causing advancement of the printable stock transversely relative to each said horizontal line of characters after printing thereof, thereby spacing each horizontal line of printed characters from the next ensuing horizontal line of characters to be printed; said line-advancing means including means responsive to said electrical signals by varying the amount of spacing between certain successive character lines as a function of particular actuation of said control key, said amount of spacing having at least three settings; said line-advancing means being responsive to particular electrical signals produced by said particular actuation of said control key by varying the line spacing between certain horizontal character lines in the particular number of said individually variable vertical increments selected by the said particular actuation of said control key.

6. The control system of claim 5, wherein said line-advancing means is reponsive to repeated electrical signals produced by repeated control key actuation by varying the number of vertical increments contained in a single standard line spacing, and thereby varying the spacing between certain character lines in incremental amounts related in number to the number of repeated control key actuations.

7. The control system of claim 6, wherein said line-advancing means includes means which are conditioned by said particular control key actuation to cause printing of a pair of character lines at the vertical increment spacing determined by said particular control key actuation.

8. In a data printing machine having a print head, a print head drive means coupled to said print head for laterally moving said print head to any of a plurality of mutually-spaced known positions along a print head lateral travel path, and a print media drive means for incrementally advancing a printing media with respect to said print head in a manner whereby successive lines of data printed on said printing media along said print head lateral travel path lie generally parallel to one another and in a manner whereby adjacent lines of data have a standard line spacing between them, said standard line spacing comprising a particular number of vertical increments, a positioning means including:

a position-monitoring means operatively coupled to at least one of said print head and said print head drive means, for determining the lateral position of said print head along said path relative to a known reference location therealong;

memory means operatively coupled to said position-monitoring means and said print media drive means for storing indicia representative of said lateral position of said print head, representative of said known reference location, representative of a given left-hand margin position and indicia representative of certain of said particular number of vertical increments of printing media advancement;

control means coupled to said memory means, to said position-monitoring means, to said print media drive means, and to said print head and said print head drive means, for controlling the position of said print head relative to said printing media and said travel path, and actuating said print head to print along said path;

a keyboard coupled to said control means for providing an interface for transmission of control signals from an operator to said control means, said control means selectively responding to said control signals to set said left-hand margin position and the vertical spacing between printed lines; said keyboard including:

a left-direction head drive control means coupled to said print head drive means and to said memory means for moving said print head to the left of said set left-hand margin position, in order to reset said left-hand margin position leftward; and a right-direction head drive control means coupled to said print head drive means and to said memory means for moving said print head to the right of said set left-hand margin position, in order to reset said left-hand margin position rightward; and a run state control means for enabling said left-direction head drive control means to reset said left-hand margin position to the left a predetermined number of said mutually-spaced known positions for each increment of operation of said left-direction head drive control means; said left-direction head drive control means operable independently of the position of said print head along said lateral print head travel path and during periods of relative print head movement as during printing by said data printing machine, and for enabling said right-direction head drive control means to reset said left-hand margin position to the right a predetermined number of said mutually-spaced known positions, for each increment of operation of said right-direction head drive control means, said right-direction head drive control means operable independently of the position of said print head along said lateral print head travel path and during periods of relative print head movement as during printing by said data printer.

9. A data printing machine and positioning means as recited in claim 8 wherein:

said keyboard includes line spacing-varying means operatively associated with said memory means, with said print head drive means and with said print media drive means, for actuating a change in the number of said vertical increments between certain successive lines of printed data to change the vertical spacing between said certain successive printed lines;

said memory means being further capable of storing indicia representative of the changed number of vertical increments representing said changed vertical spacing; and said control means includes a print media positioning means for controlling said print media drive means to position said printing media so that said certain successive lines of data printed on said printing media have said changed vertical spacing between lines.

10. A data printing machine as recited in claim 9 wherein said position-monitoring means includes:

an encoder coupled to said print head drive means for producing an electrical output signal in response to lateral movement of said print head along said travel path; and logic means coupled to said encoder for generating a print head binary number address defining each location of said print head relative to said known reference location as the print head moves along said travel path past said known position.

11. A data printing machine as recited in claim 10 wherein said keyboard includes:

a left-hand margin set key coupled to said memory means for causing storage, upon actuation, of the particular print head binary number address for the print head position at the time of actuation as a left-hand margin position.

12. A data printing machine as recited in claim 11 wherein said keyboard includes:

an up-line position means for decreasing by steps of at least one number of said vertical increments between a successively printed pair of lines of data, and a down-line position means for increasing by steps of at least one the number of said vertical increments between a successively printed pair of lines of data.

13. A data printing machine as recited in claim 12 wherein said keyboard includes:

a set-up state control means for enabling said left-direction head drive control means to move said print head to the left as long as said left-direction head drive control means are enabled, and for enabling said right-direction head drive control means to move said print head to the right as long as said right-direction head drive control means are enabled.

14. A data printing machine as recited in claim 13 wherein actuation of said left-direction head drive control means actuates said print head drive means as long as said left-direction head drive control means remains actuated and causes accelerating movement of said print head to the left during such long actuations, and wherein actuation of said right-direction head drive control means actuates said print head drive means as long as said right-direction head drive control means remains actuated and causes accelerating movement of said print head to the right during these long actuations.

15. A data printing machine as recited in claim 10 wherein said logic means includes:

up-counting means coupled to said encoder for adding a binary unit to the binary number address of said mutually-spaced known positions along said path in response to said print head traversing each of said mutually-spaced known positions while moving in a first direction; and down-counting means coupled to said encoder for subtracting a binary unit from said binary number addresses in response to said print head traversing each of said mutually-spaced known positions while moving in a second direction, opposite from said first direction.

16. A data printing machine as recited in claim 15 wherein said known reference location has a binary number address different from, and intermediate in magnitude the largest and smallest of the binary number addresses of the mutually-spaced known positions along said print head lateral travel path.

17. A method of printing data for a data printer by using a print head drive means to drive a print head laterally along a printing surface and past a plurality of mutually-spaced known positions lying along a lateral print head travel path, and vertically positioning said printing surface with respect to said print head such that successive lines of data printed on said printing surface along said print head lateral travel path have predetermined vertical spacing between said lines of data, and including the positioning of the print head by the steps of:

laterally moving said print head to a desired margin position along said travel path;

using electrically actuated signal means and a digital memory device to store a coded signal which identifies said desired margin position;

using said stored coded signal in an electrical control means to index the printing of data by said print head so that the lines of data printed thereby are indexed at said desired margin position; and establishing a "run" state during which the print head moves laterally along said travel path printing characters and a left-direction print head drive control means is enabled in a manner to move a left-hand margin to the left incrementally in response to operation of said left-direction print head drive control means, said left-direction print head drive control means being operable independently of the position of said print head along said lateral print head travel path and during periods of relative print head movement as during printing by said data printer, and during which a right-direction print head drive control means is enabled in a manner to move said left-hand margin to the right incrementally in response to operation of said right-direction print head drive control means, said right-direction print head drive control means being operable independently of the position of said print head along said lateral print head travel path and during periods of relative print head movement as during printing by said data printer.

18. A method of printing data as recited in claim 17 further including the steps of:

vertically advancing said printing surface with respect to said print head by incremental movements between successive printed lines, a standard line spacing between successive lines comprising a plurality of vertical increments;

adjusting the number of said vertical movement increments, so as to change the number of vertical increments contained in a standard line spacing, to set a desired vertical line spacing between a pair of successive lines of data;

storing coded signals indicative of the number of increments setting said desired vertical line spacing in a memory means; and using said stored coded signals to successively position said printing surface so that said pair of successive lines of data are subsequently printed at said desired vertical line spacing.

19. A method of printing data as recited in claim 18 further comprising determining a first lateral position of said print head along said travel path relative to a known reference location along said travel path by use of a displacement monitoring means operatively coupled to said print head, including the steps of:

coupling an encoder to said print head drive means;

producing an electrical output signal from said encoder in response to movement of said print head;

using electronic decoding means coupled to the output of said encoder to determine the direction and amount of print head displacement relative to said known reference location along said travel path; and producing from the output of said decoding means a print head binary number address identifying the location of said print head.

20. A method of printing data as recited in claim 19 further comprising:

establishing a set-up state in said data printer during which a left-direction head drive means is enabled to move said print head to the left as long as said left-direction head drive means are enabled, and during which a right-direction head drive means is enabled to move said print head to the right as long as said right-direction head drive means are enabled.

21. A method of printing data as recited in claim 20 further comprising:

electrically storing said print head binary number address and using the stored address as a margin position indicator.

22. A method of printing data as recited in claim 21 further comprising:

causing continuing movement of said print head to the left during actuation of said left-direction head drive means; and causing continuing movement of said print head to the right during actuation of said right-direction head drive means.

23. A method of printing data as recited in claim 22 further comprising:

decreasing the number of said vertical movement increments between certain successive printed lines of data in response to actuation of an up-line position means; and increasing the number of said vertical movement increments between certain successive printed lines of data in response to actuation of a down-line position means.

24. A method of printing data as recited in claim 20 further comprising:

moving said print head along said travel path and past said known reference location;

assigning to said print head when positioned at said reference location a print head binary number address greater in magnitude than the binary magnitude of all of said mutually-spaced known positions to one side of said print head along said print head lateral travel path; and adding a binary unit to said reference location print head binary number address in response to said print head traversing each of said mutually-spaced known positions along said path in a first direction away from said reference location, and subtracting a binary unit from said reference location print head binary number address in response to said print head traversing each of said positions along said path in a second direction, opposite from said first direction.

* * * * *